US007456829B2

(12) United States Patent
Fry

(10) Patent No.: US 7,456,829 B2
(45) Date of Patent: Nov. 25, 2008

(54) METHODS AND SYSTEMS TO CONTROL ELECTRONIC DISPLAY BRIGHTNESS

(75) Inventor: Walter G. Fry, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 659 days.

(21) Appl. No.: 11/003,774

(22) Filed: Dec. 3, 2004

(65) Prior Publication Data

US 2006/0119564 A1 Jun. 8, 2006

(51) Int. Cl.
*G09G 5/00* (2006.01)

(52) U.S. Cl. ..... 345/204; 345/690

(58) Field of Classification Search ..... 345/50, 345/55–109, 511–526, 211, 212, 690; 715/745, 715/747; 348/602; 713/300, 320, 322
See application file for complete search history.

(56) References Cited

U.S. PATENT DOCUMENTS

| | | | | |
|---|---|---|---|---|
| 5,786,801 | A | 7/1998 | Ichise et al. | |
| 6,078,302 | A | 6/2000 | Suzuki et al. | |
| 6,094,185 | A | 7/2000 | Shirriff | |
| 6,188,433 | B1 * | 2/2001 | Orbock | 348/297 |
| 6,411,306 | B1 | 6/2002 | Miller et al. | |
| 6,520,912 | B1 * | 2/2003 | Brooks et al. | 600/437 |
| 6,795,053 | B1 * | 9/2004 | Funamoto et al. | 345/102 |
| 7,136,076 | B2 * | 11/2006 | Evanicky et al. | 345/600 |
| 7,233,307 | B2 * | 6/2007 | Miura et al. | 345/100 |
| 7,265,743 | B2 * | 9/2007 | Funamoto et al. | 345/102 |
| 2003/0071657 | A1 * | 4/2003 | Soerensen et al. | 326/93 |
| 2003/0169226 | A1 | 9/2003 | Yamada | |
| 2004/0085276 | A1 | 5/2004 | Kim | |
| 2004/0104886 | A1 | 6/2004 | Kawano | |
| 2004/0160435 | A1 | 8/2004 | Cui et al. | |

FOREIGN PATENT DOCUMENTS

| | | |
|---|---|---|
| EP | 1223570 | 7/2002 |
| JP | 2003319291 A | 7/2003 |
| JP | 2003084857 A | 8/2003 |
| JP | 2003226062 A | 12/2003 |

* cited by examiner

*Primary Examiner*—Nitin Patel

(57) ABSTRACT

In at least some embodiments, a system may comprise a processor and a controller coupled to the processor. The system may further comprise an electronic display coupled to the controller, wherein the controller is configured to interpret a plurality of control signals, each control signal able to dynamically control electronic display brightness without user input, and to generate an output signal to control electronic display brightness based on the interpreted control signals.

31 Claims, 6 Drawing Sheets

METHODS AND SYSTEMS TO CONTROL ELECTRONIC DISPLAY BRIGHTNESS

BACKGROUND

In portable electronic devices (e.g., laptop computers) configured to function using battery power, methods and systems that efficiently control power consumption are important. In particular, the power consumed by an electronic display may be significant. Therefore, methods and systems that decrease power consumption by electronic displays are desirable. Further, methods and systems that selectively combine different technologies to control power consumption by electronic displays are desirable.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct electrical connection. Thus, if a first device couples to a second device, that connection may be through a direct electrical connection, or through an indirect electrical connection via other devices and connections. The term "system" refers to a collection of two or more parts and may be used to refer to a computer system or a portion of a computer system. The term "graphics" refers to text, images, or other information displayable by an electronic display.

DETAILED DESCRIPTION

As disclosed herein, embodiments of the invention control electronic display brightness. In some embodiments this is accomplished by selectively implementing control parameters associated with different technologies. In at least some embodiments, two or more controllers are implemented. The first controller (e.g., a graphics controller) is configured to output a first control signal based on a first technology (e.g., a technology that controls display brightness based on graphics shown or graphics to be shown on an electronic display). The second controller is configured to receive and interpret the first control signal as well as control signals associated with other technologies. Each interpreted control signal is associated with a unique control parameter. The second controller selectively combines the effect of the control parameters to provide a signal that efficiently controls electronic display brightness.

A user or manufacturer may choose not to employ hardware/software or licenses necessary to implement a particular technology. Additionally, a technology may not be compatible with some embodiments. In some embodiments, if the second controller determines that the first controller is not present or is otherwise not providing a valid first control signal, the second controller is configured to automatically control electronic display brightness based on one or more of the other control signals. Therefore, some embodiments of the invention enable interpretation and combination of electronic display control signals to permit efficient power consumption by an electronic display. The control signals may be generated by controllers that operate independently of each other. Some embodiments of the invention also enable redundancy and improved efficiency in an environment in which compatibility problems may exist or may change over time.

Figure 1:
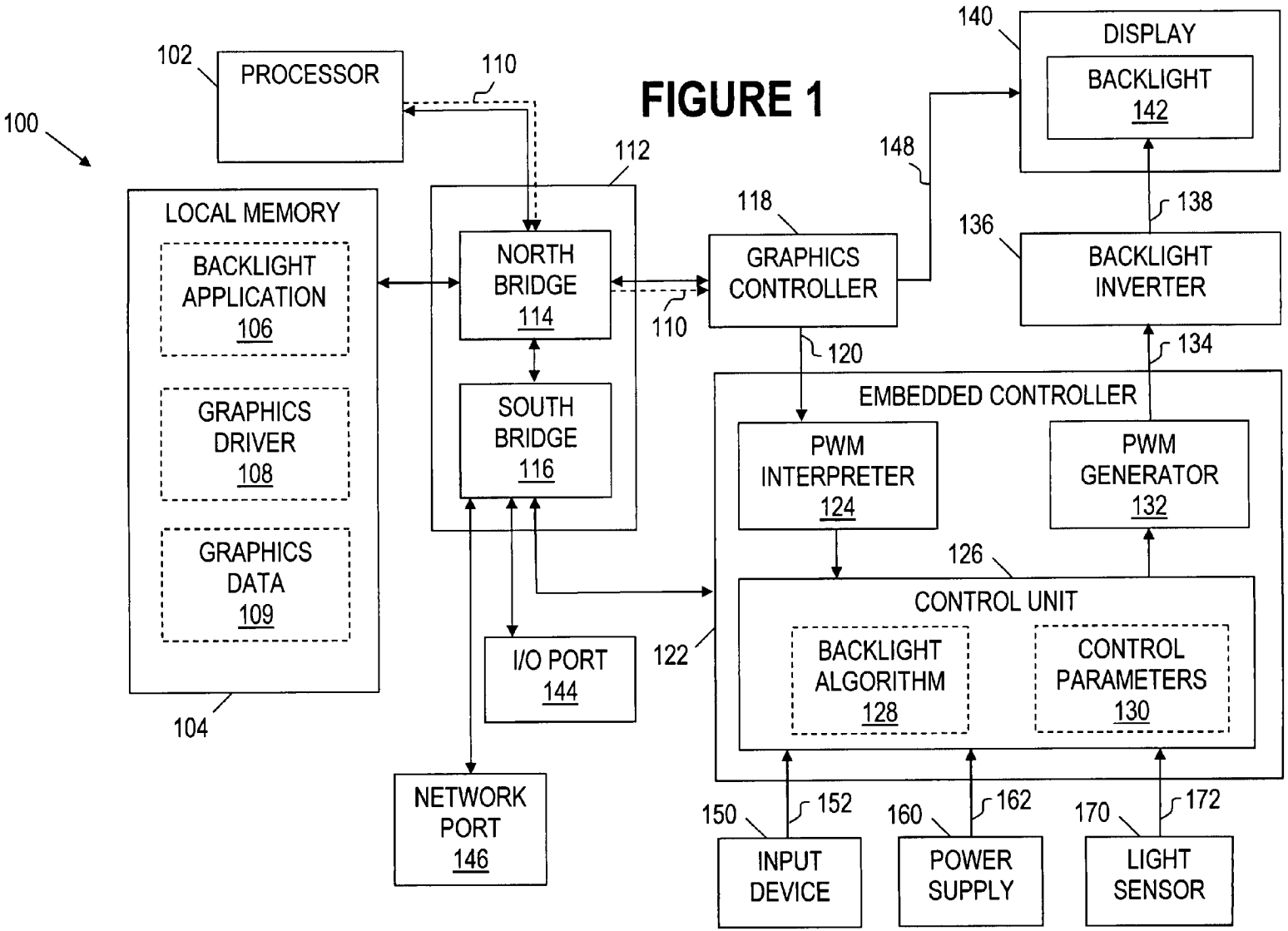
FIG. 1 illustrates a system in accordance with embodiments of the invention.

FIG. 1 illustrates a system 100 in accordance with embodiments of the invention. As shown in FIG. 1, the system 100 comprises a processor 102 coupled to a graphics controller 118 and a local memory 104 via a chipset 112. The chipset 112 comprises a north bridge 114 and a south bridge 116 that control data to be transmitted between the processor 102, the local memory 104 and the graphics controller 118. In some embodiments, the graphics controller 118 and the chipset 112 may be combined as a single unit. The processor 102 executes computer-readable instructions stored in the local memory 104 or other storage mediums accessible to the processor 102. For example, other storage mediums may couple to the input/output ("I/O") port 144 or to the network port 146 and provide computer-readable instructions to the processor 102 via the chipset 112.

To decrease power consumption of a display 140 illuminated, for example, by a backlight 142, the system 100 implements two controllers. The first controller is the graphics controller 118 which outputs a first control signal 120 based on graphics shown or graphics to be shown on the display 140. In at least some embodiments, the first control signal 120 is generated when the processor 102 executes a backlight application 106 and a graphics driver 108 stored in the local memory 106. Alternatively, the graphics controller 118 may execute the backlight application 106 and the graphics driver 108, thereby freeing the processor 102 to perform other tasks.

The graphics driver 108, when executed, enables the processor 102 (or the graphics controller 118) to access graphics data 109 stored in the local memory 104 and convert the graphics data 109 to a signal 148 that produces an image on the display 140. Although the graphics data 109 is described as being stored in the local memory 104, the graphics data 109 may alternatively be stored in a memory (not specifically shown) of the graphics controller 118. The graphics data 109 may be generated, for example, when the processor 102 executes or installs one or more software applications.

The backlight application 106, when executed, causes the processor 102 to examine the graphics data 109. For example, examining the graphics data 109 enables the processor 102 to determine the position/quantity of light pixels, the position/quantity of dark pixels, or an average grayscale of pixels. In response to examining the graphics data 109, the processor 102 asserts a signal 110 that causes the graphics controller 118 to output a control signal 120 capable of dynamically controlling electronic display brightness based on the graphics data 109. Alternatively, the graphics controller 118 may be configured to execute the backlight application 106 and to generate the first control signal 120 without the processor 102 nor the signal 110, thereby freeing the processor 102 to perform other tasks.

The first control signal 120 may be a pulse-width modulation (PWM) signal interpretable by a backlight inverter 136. Rather than provide the first control signal 120 directly to the backlight inverter 136, the graphics controller 118 couples to and outputs the first control signal 120 to a second controller, for example, an embedded controller 122.

Figure 2A:
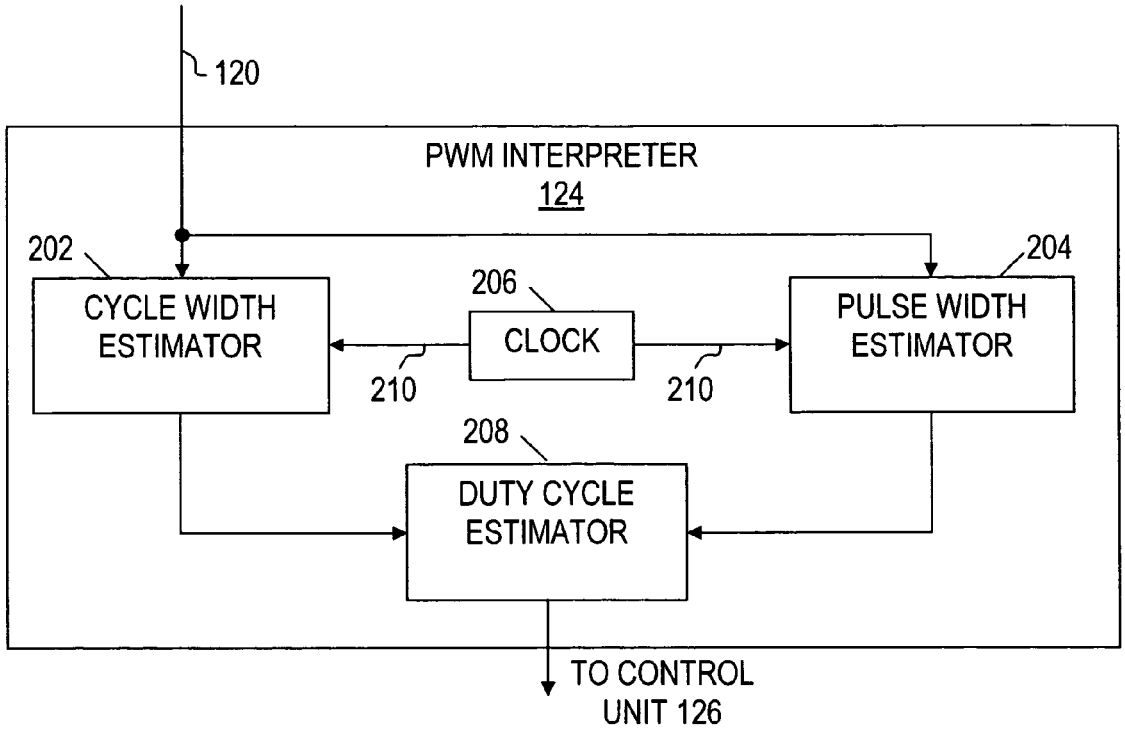
FIGS. 2A and 2B illustrate pulse-width modulation ("PWM") interpreters in accordance with embodiments of the invention.

As shown in FIG. 1, the embedded controller 122 comprises a PWM interpreter 124 coupled to a control unit 126. The PWM interpreter 124 receives the first control signal 120 from the graphics controller 118 and interprets the first control signal 120. FIG. 2A illustrates a PWM interpreter 124 in accordance with various embodiments of the invention. As shown in FIG. 2A, the PWM interpreter 124 comprises a cycle-width estimator 202 and a pulse-width estimator 204 that receive the first control signal 120. The PWM interpreter 124 also comprises a clock generator 206 coupled to the cycle width-estimator 202 and the pulse-width estimator 204. The clock generator 206 provides a clock signal 210 whose cycle is shorter than either the pulse width or the modulation cycle-width to be estimated. By shortening the cycle of the clock signal 210 with respect to the pulse-width or cycle-width, the resolution of the pulse-width estimation and the modulation cycle-width estimation is increased.

The cycle-width estimator 202 estimates the duration of a pulse-width modulation cycle by counting a number of clock cycles (of the clock signal 210) between subsequent rising edges of the first control signal 120. The pulse-width estimator 204 estimates the duration of a pulse by counting a number of clock cycles (of the clock signal 210) between rising edges and subsequent falling edges (i.e., between each pulse) of the first control signal 120. The duty-cycle estimator 208 receives a clock count from each of the cycle-width estimator 202 and the pulse-width estimator 204 and outputs a signal that indicates the estimated duty-cycle. For example, if the clock count from the cycle-width estimator 202 is 40 and the clock count from the pulse-width estimator 204 is 30, the duty-cycle estimator 208 outputs a signal that indicates the duty-cycle is 75% (i.e., the pulse is "on" or "high" for 75% of each modulated cycle).

In alternative embodiments, the cycle-width estimator 202 may simply estimate the "low-pulse" duration (i.e., when the pulse is "off" or "low") rather than the entire modulated cycle duration. For example, the low-pulse duration may be estimated by counting a number of clock cycles (of the clock signal 210) between falling edges and subsequent rising edges (i.e., between each low pulse) of the first control signal 120. In such embodiments, the duty-cycle estimator 208 compares the clock count from the pulse-width estimator 204 with the clock count of the low-pulse duration and outputs a signal that indicates the estimated duty-cycle. For example, if the clock count from the pulse-width estimator 202 is 20 and the clock count of the low-pulse duration is 20, the duty-cycle estimator 208 may output a signal that indicates the duty-cycle is 50% (i.e., the pulse is "on" or "high" for one-half or 50% of each modulated cycle).

Figure 2B:
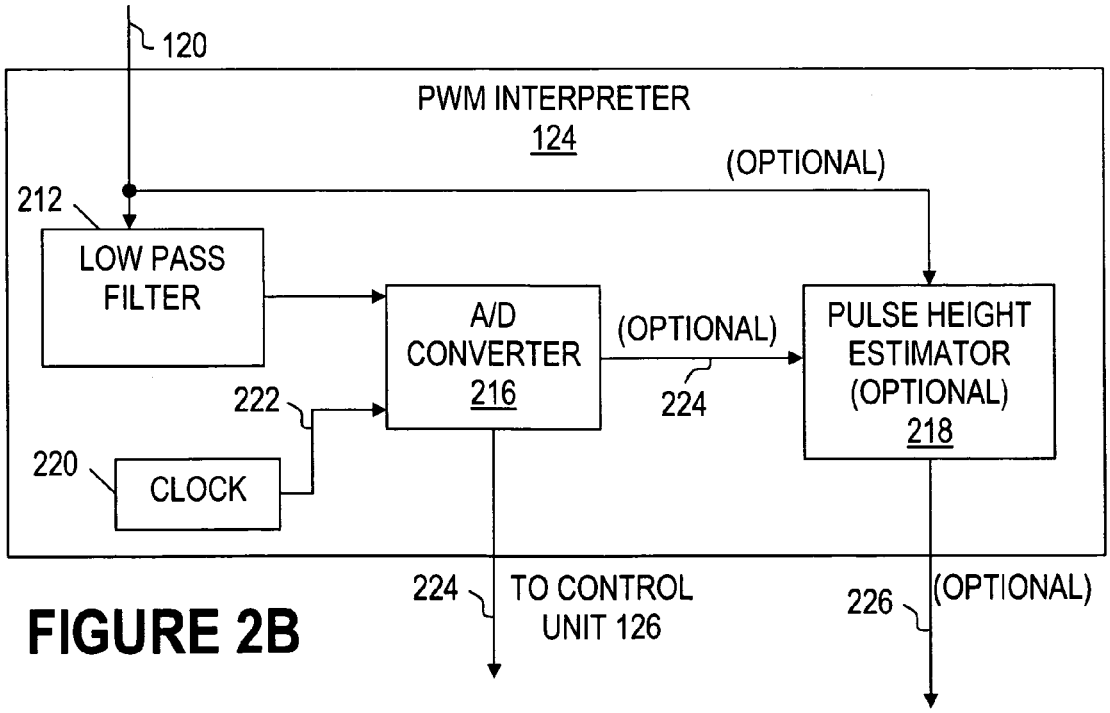

FIG. 2B illustrates another PWM interpreter 124 in accordance with embodiments of the invention. As shown in FIG. 2B, the PWM interpreter 124 comprises a low-pass filter 212 coupled to an analog-to-digital (A/D) converter 216. The first control signal 120 is input to the low-pass filter 212 and optionally input to a pulse-height estimator 218. The low-pass filter 212 outputs an average or "mean" voltage associated with the first control signal 120 over a predetermined time period. The predetermined time period may be a sampling rate at which the A/D converter 216 samples the output of the low-pass filter 212. For example, a clock signal 222 provided by a clock generator 220 may be input to the A/D converter 214 to control the sampling rate. If the sampling rate is approximately equal to the modulation cycle-width, the output voltage 224 of the A/D converter 216 indicates the duty-cycle of the first control signal 120 (e.g., an output voltage 224 of 3V indicates a duty cycle of 75% when the "on" or "high" voltage associated with pulses of the first control signal 120 is known to be 4V). Therefore, in some embodiments, the control unit 126 of the embedded controller 122 shown in FIG. 1 associates the output voltage 224 with a duty-cycle.

Optionally, if the "on" or "high" voltage associated with pulses of the first control signal 120 is not known, the pulse-height estimator 218 shown in FIG. 2B approximates the magnitude of the "high" voltage. The pulse-height estimator 218 also may compare the filtered output voltage 224 with the "high" voltage and output a signal 226 that indicates the duty-cycle (e.g., if the output voltage 224 is 2V and the "high" voltage is determined to be 4V, the signal 226 may indicate a duty cycle of 50%).

Returning to FIG. 1, the control unit 126 receives the output from the PWM interpreter 124. As shown, the control unit 126 comprises a backlight algorithm 128 and control parameters 130. At least one control parameter 130 may be based on the control signal 120 interpreted by the PWM interpreter 124. Additionally, other control parameters 130 may be based on a signal 152 from an input device 150 (e.g., a keyboard, mouse, or buttons on a display), a signal 162 from a power supply 160, or a signal 172 from a light sensor 170 (e.g., an ambient light sensor). For example, the signal 152 indicates when a user selects (via the input device 150) to change the brightness of the display 140. The signal 162 indicates when the system 100 is disconnected from an alternating current ("AC") power supply or other external power supply. Additionally or alternatively, the signal 162 may indicate when less than one or more thresholds of battery power remains. The signal 172 indicates an amount of ambient light that surrounds the display 140. In some embodiments, one or more of the signals 120, 152, 162, 172 may include a "signature" that indicates a source of the signal and/or a health of the device providing the signal.

In the exemplary embodiment of FIG. 1, the embedded controller 122 is shown receiving the signals 120, 152, 162, 172. However, other embodiments may implement additional signals or fewer signals depending on the technology (e.g., hardware/software) that is available for a particular system. For example, the hardware/software needed to create the signals 120, 152, 162, 172 may not be implemented in some embodiments or may not be functioning properly. Thus, the embedded controller 122 is configured to determine the existence of the signals 120, 152, 162, 172 and the validity of the signals 120, 152, 162, 172. For example, if the control unit 126 does not receive a particular signal (e.g., if a voltage level associated with the PWM interpreter 124 output or associated with one of the signals 152, 162, 172 is less than a threshold level), the control unit 126 may automatically determine that the particular signal does not exist or is not available.

Additionally or alternatively, the embedded controller 122 may be configured to receive hardware/software inventory information (e.g., information that indicates whether certain hardware/software has been installed in the system 100) that indicates whether a given signal does or should exist. If the embedded controller 122 does not receive a given signal that should exist, an alert or message may be generated to notify a user of the problem. Likewise, if the embedded controller 122 receives the given signal (e.g., the voltage level associated with the signal is equal to or greater than a threshold level), but the frequency and/or the magnitude of the given signal does not fall within a predetermined "valid" threshold associated with the given signal, the embedded controller 122 may automatically identify the given signal as invalid. Upon identifying an invalid signal, the embedded controller 122 may generate an alert or message to notify a user of the problem. In some embodiments, a value associated with a given control parameter changes based on whether a signal associated with the given control parameter exists (or is available) and whether the signal is valid. Thus, the control parameters 130 can be used to identify whether a signal (e.g., signal 120, 152, 162, 172) exists and whether a signal is valid.

In some embodiments, the backlight algorithm 128 implements the control parameters 130 and outputs a signal that takes some or all of the control parameters 130 into account. For example, the backlight algorithm 128 may differently weight each of the control parameters 130. Additionally or alternatively, the control parameters 130 may be prioritized according to a predetermined prioritization that minimizes power consumption by the backlight 142 in a variety of situations encompassed (i.e., describable) by the control parameters 142. In some embodiments, a user can adjust the effect of the control parameters 130 on the backlight algorithm 128.

As an example, the backlight illumination provided by the backlight algorithm 128 is generally described the equation (1) shown below:

$$\text{Backlight illumination}=F(CP_1, CP_2, CP_3, CP_4); \quad (1)$$

In equation 1, the backlight illumination is a function (F) of the control parameters 130 ($CP_1$, $CP_2$, $CP_3$, $CP_4$). $CP_1$ is a numeric value associated with the first control signal 120, $CP_2$ is a numeric value associated with the signal 152, $CP_3$ is a numeric value associated with the signal 162 and $CP_4$ is a numeric value associated with the signal 172. The numeric value associated with each control parameter 130 may be unique and may be based on a range of possible values provided by the signals 120, 152, 162 and 172.

An example of the function, $F(CP_1, CP_2, CP_3, CP_4)$, is described in the equation (2) shown below:

$$\text{Backlight illumination}=\alpha*CP_1+\beta*CP_2+\lambda*CP_3+\zeta*CP_4 \quad (2)$$

In equation 2, each control parameter 130 ($CP_1$, $CP_2$, $CP_3$, $CP_4$) is multiplied by a variable ($\alpha$, $\beta$, $\lambda$, and $\zeta$) and the results added together. Each variable may be set or reset to a default value when the system 100 is "powered up." The default values may be predetermined to minimize power consumption by a backlight 142 and may be adjustable by a user. In some embodiments, the value affixed to each variable may be adjusted within a range (e.g., −1.00 to 1.00 or 0.00 to 1.00) assigned to each variable. Each variable may be automatically adjusted based on the validity of each control parameter 130.

Sometimes the validity (utility) of one or more of the control parameters 130 may be affected by a manufacturer or a user of the system 100. Additionally, one or more components (e.g., the graphics controller 118, the local memory 104, the PWM interpreter 124, the input device 150, the power supply 160, the light sensor 170) of the system 100 that affect the control parameters 130 may be temporarily or permanently disabled. Therefore, embodiments of the invention enable the ability to adjust, ignore or disable one or more of the control parameters 130 while permitting uninterrupted backlight control based on remaining control parameters 130, thus, providing a wide variety of desirable functions.

For example, if one or more of the backlight application 106, the graphics driver 108 or the graphics controller 118 is not functioning (e.g., due to a fault, incompatibility or exclusion from the system 100), the first control signal 120 and, consequently, the control parameter 130 ($CP_1$) based on the first control signal 120 is likely to be invalid or nonexistent. Therefore, the control unit 126 of the embedded controller 122 is configured to detect when the first control signal 120 (or the output from the PWM interpreter 124) is invalid or does not exist and cause the variable associated with CP, (in the above example, "$\alpha$") to equal zero. The control unit 126 may accordingly adjust the weights of the remaining control parameters 130.

The control unit 126 also may be configured to detect whether one or more of the other signals 152, 162 and 172 are invalid or nonexistent. If any of these signals is determined to be invalid, the control unit 126 may "zero out" or nullify the variable associated the consequently invalid control parameter 130 and cause the backlight algorithm 128 to continue functioning using the remaining control parameters 130.

In at least some embodiments, the function (F) of the backlight algorithm 128 allows continuous control of electronic display brightness, even when one or more components that affect the control parameters 130 stops functioning or is faulty (or not detected) when the system 100 "powers up." Additionally, the control unit 126 may be configured to automatically activate the use of a control parameter 130 when a determination is made that a signal (e.g., the first control signal 120, the signal 152, the signal 162 or the signal 172) associated with the respective control parameter 130 is valid. Therefore, when a manufacturer or user installs (or repairs) the hardware, software, or licenses necessary to provide a valid control signal, the control unit 126 activates (or reactivates) a corresponding control parameter 130 of the backlight algorithm 128.

The control unit 126 outputs a signal to the PWM generator 132 based on the backlight algorithm 128 and the control parameters 130. The PWM generator 132 then outputs a corresponding PWM signal 134 to the backlight inverter 136. The backlight inverter 136 converts the PWM signal 134 to a signal 138 compatible with the backlight 142. The signal 138 causes the backlight 142 to emit light at an intensity determined by the PWM signal 134.

Figure 3:
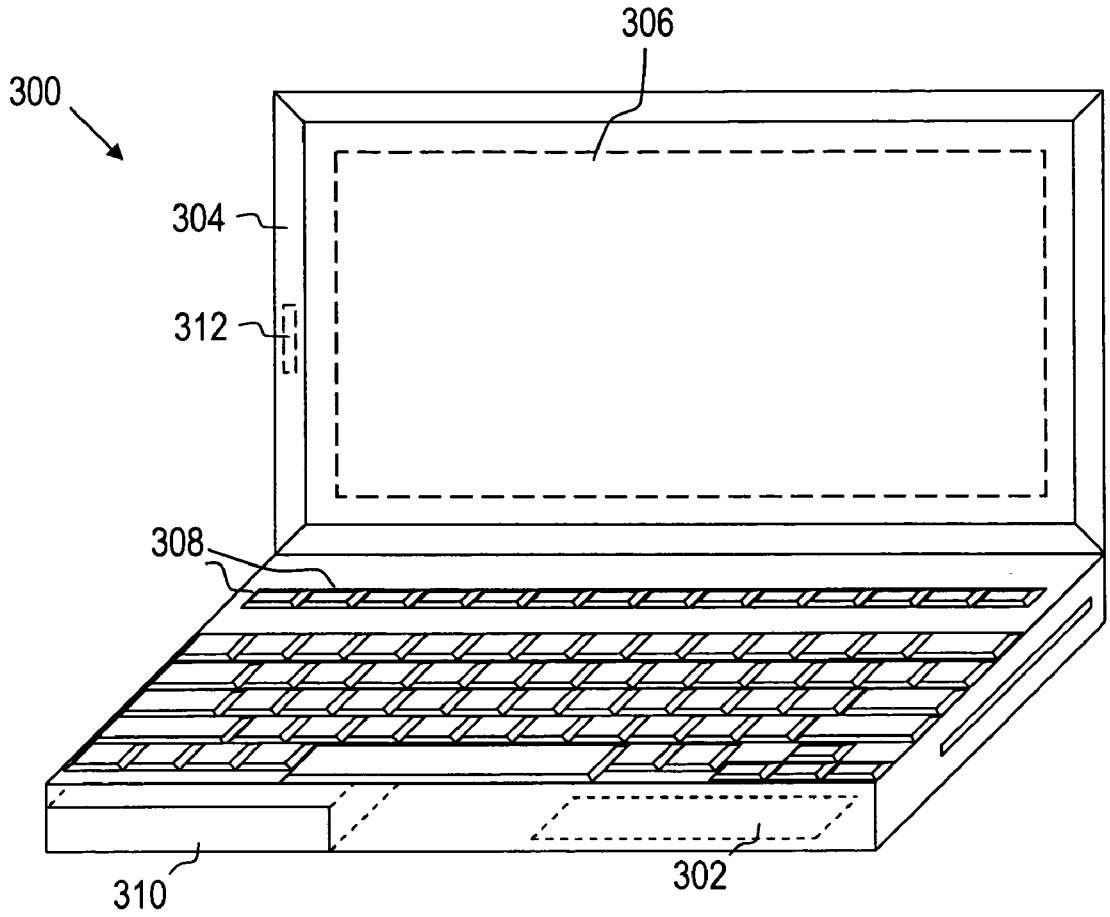
FIG. 3 illustrates an electronic device in accordance with embodiments of the invention.

FIG. 3 illustrates an electronic device 300 in accordance with embodiments of the invention. As shown in FIG. 3, the electronic device 300 is a laptop computer having a display 304. However, embodiments of the invention are not limited to laptop computers and may comprise any electronic device with a display. The electronic device 300 comprises a battery 310 that provides power when the device 300 is not electrically connected to an AC power supply or other external power supply. The electronic device 300 also comprises a backlight 306 that illuminates the display 304 as well as an ambient light sensor 312 and buttons (or keys) 312 that permit a user to control one or more functions of the electronic device 300.

In order to control an amount of illumination provided by the backlight 306, the electronic device 300 implements the components previously described in FIG. 1. At least some of the components described in FIG. 1 (e.g., the processor 102, the local memory 104, the chipset 112, the graphics controller 118 and the embedded controller 122) may be implemented internally and coupled together using a printed circuit (PC) board 302.

For example, an embedded controller (e.g., a keyboard controller or a power supply controller) as described for FIG. 1 may be affixed to the PC board 302 and configured to receive control signals from the battery 310, one or more buttons 308, the ambient light sensor 312 or a graphics controller. By interpreting the control signals or a parameter associated with the control signals, the embedded controller outputs a backlight control signal (e.g., a PWM signal) that determines the brightness of the backlight 306. If any of the control signals are not provided (e.g., due to malfunction of components, incompatibility, decisions made by a manufacturer or a user), the embedded controller provides the backlight control signal based on the other control signals. In at least some embodiments, the embedded controller implements an algorithm (e.g., by default) calculated to minimize power consumption by the backlight 306 (or at least decrease power consumption) by combining the effect of the different control signals.

For example, controlling the backlight 306 based on graphics, ambient light and power remaining in the battery 310 provides improved efficiency compared to implementing any of the techniques individually. In some embodiments, the backlight 306 is controlled automatically (e.g., based on graphic content, an amount of ambient light, and remaining battery power), while also permitting a user some degree of control. Additionally, the backlight control signal may be configured to adjust the backlight brightness slowly (e.g., over a time period such as 5 minutes) such that a user does not notice (at least the likelihood that a user notices is decreased) when the backlight brightness is changing.

Figure 4:
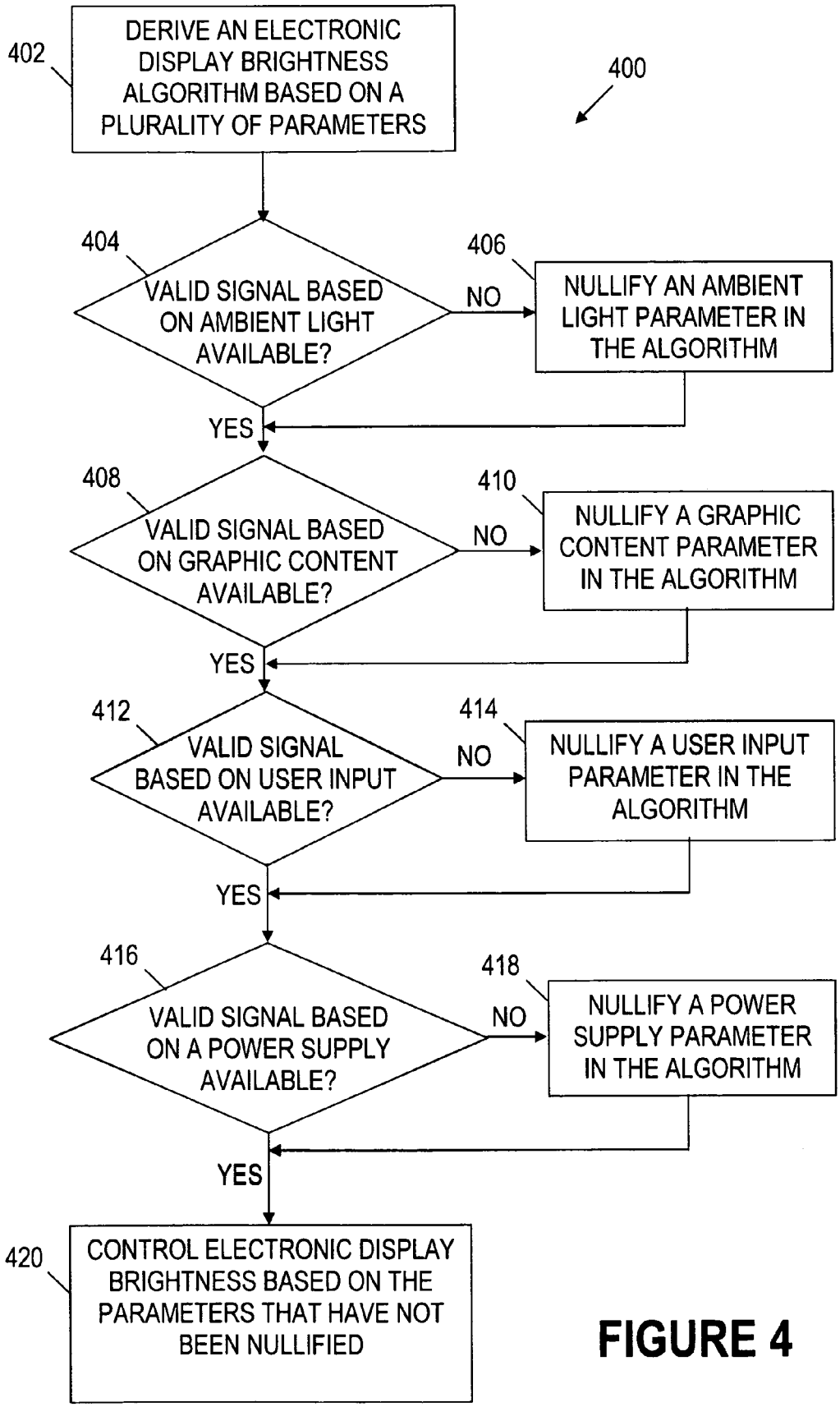
FIG. 4 illustrates a method in accordance with embodiments of the invention.

FIG. 4 illustrates a method 400 in accordance with embodiments of the invention. As shown in FIG. 4, the method 400 begins by deriving an electronic display brightness algorithm based on a plurality of parameters (block 402). The parameters may be independent or substantially independent such that electronic display brightness could be controlled using any one of the parameters. At block 404, a determination is made whether a valid signal based on ambient light is available. If a valid signal based on ambient light is not available, an ambient light parameter of the algorithm is nullified (block 406). At block 408, a determination is made whether a valid signal based on graphic content is available. If a valid signal based on graphic content is not available, a graphic content parameter of the algorithm may be nullified (block 410).

At block 412, a determination is made whether a valid signal based on user input is available. If a valid signal based on user input is not available, a user input parameter of the algorithm is nullified (block 414). At block 414, a determination is made whether a valid signal based on a power supply is available. If a valid signal based on user input is not available, a power supply parameters of the algorithm is nullified (block 416). At block 420, electronic display brightness may be controlled based on the parameters that have not been nullified.

Figure 5:
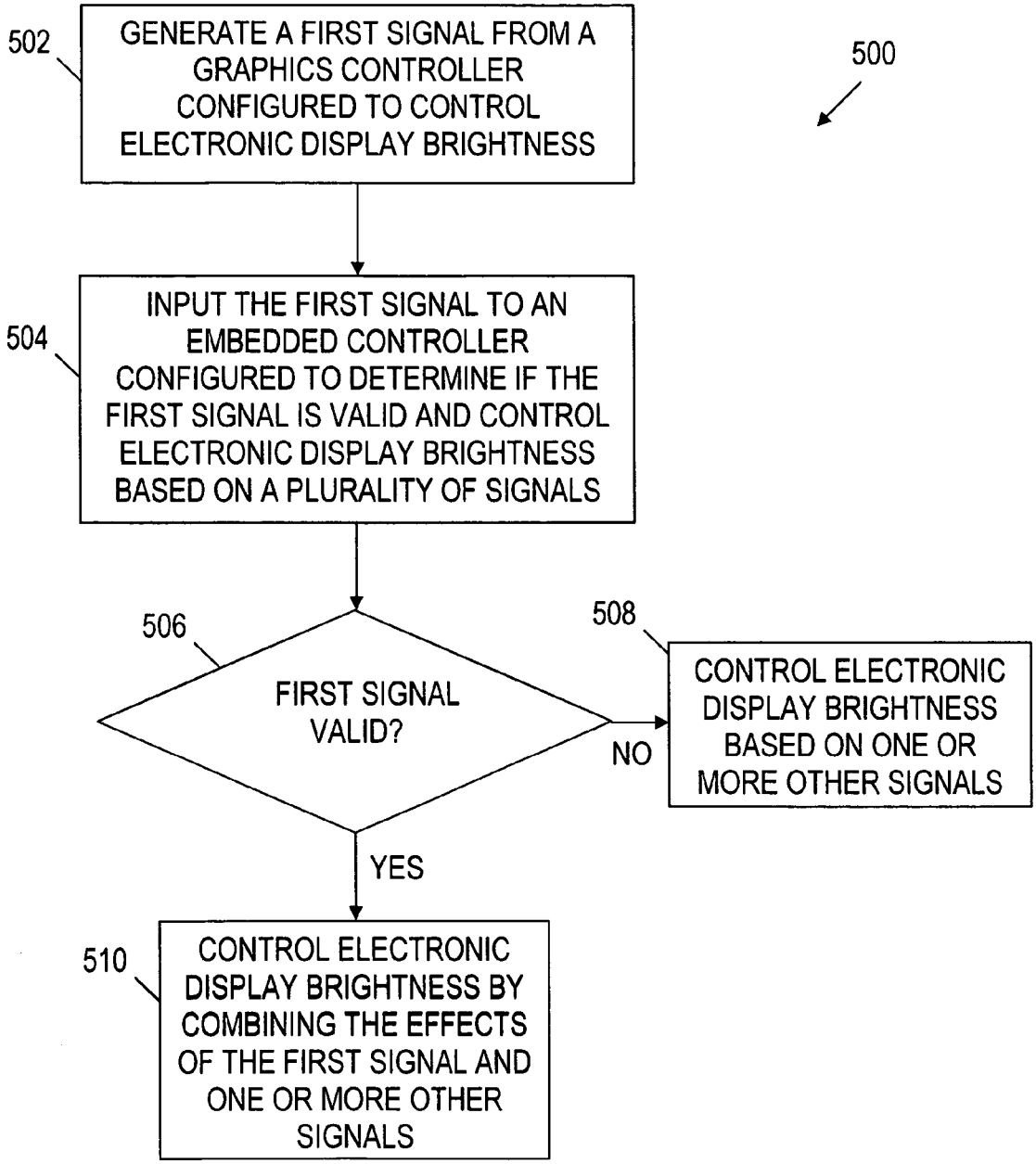
FIG. 5 illustrates another method in accordance with embodiments of the invention.

FIG. 5 illustrates another method 500 in accordance with embodiments of the invention. As shown in FIG. 5, the method 500 comprises generating a first control signal from a graphics controller configured to control electronic display brightness (block 502). At block 504, the first control signal is input to an embedded controller configured to determine if the first control signal is valid and to control electronic display brightness based on a plurality of control signals. If a determination is made (at block 506) that the first control signal is not valid, the electronic display brightness is controlled based on one or more other control signals (block 508). If a determination is made (at block 506) that the first control signal is valid, the electronic display brightness is controlled by combining the effect of the first control signal with the effect of one or more other control signals (block 510). Thus, power consumption by an electronic display may be decreased.

Figure 6:
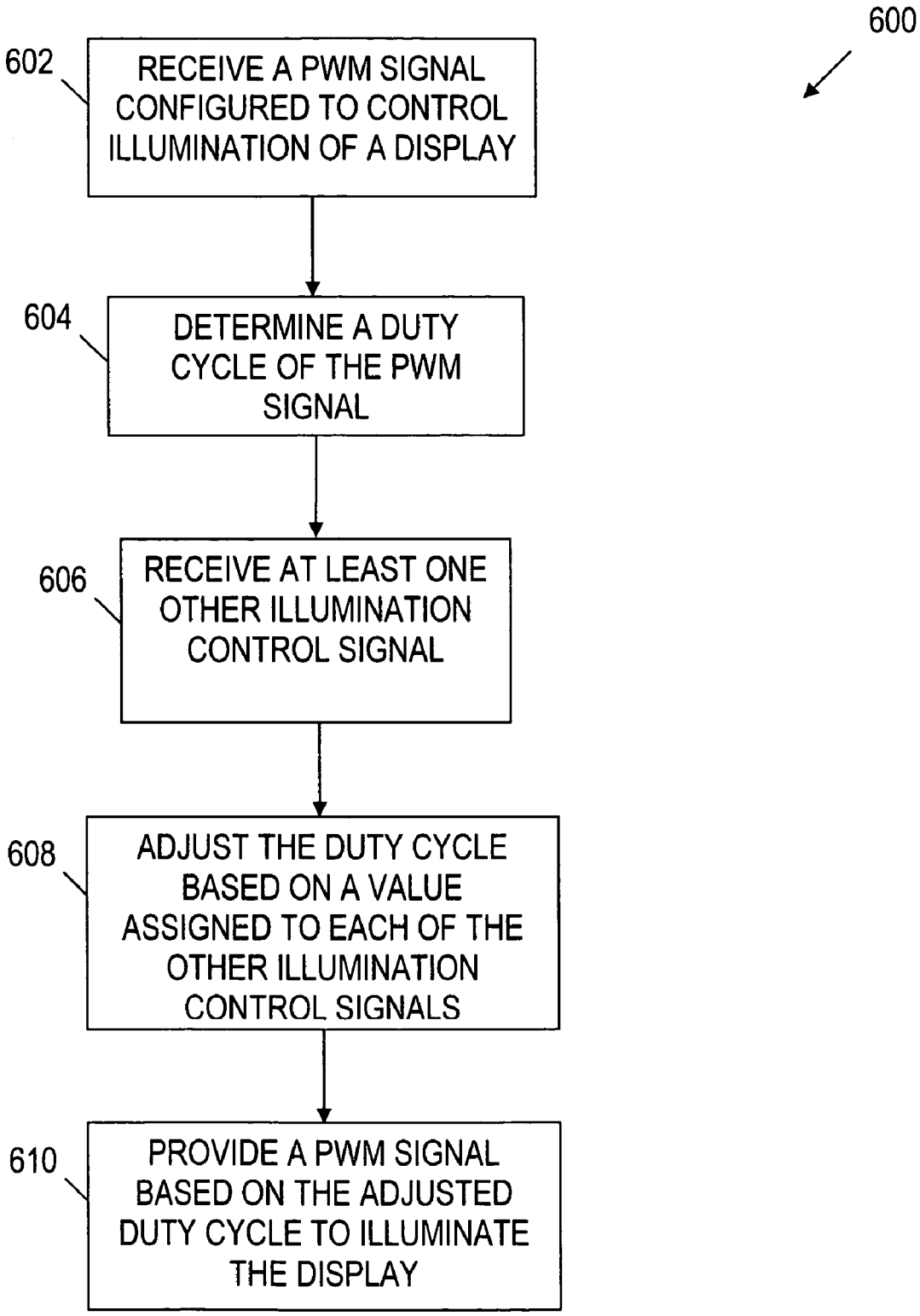
FIG. 6 illustrates another method in accordance with embodiments of the invention.

FIG. 6 illustrates another method 600 in accordance with embodiments of the invention. As shown in FIG. 6, the method 600 comprises receiving a PWM signal configured to control illumination of a display (block 602). At block 604, a duty cycle of the PWM signal is determined. At block 606, at least one other illumination control signal is received. The method 600 adjusts the duty cycle based on a value assigned to each of the other illumination control signals (block 608). The values assigned to the other illumination control signals may weight the importance of the PWM signal and the other illumination control signals with respect to each other. In some embodiments, the PWM signal and the other illumination control signals are weighted equally. Alternatively, the weighting may enable decreased power consumption by a display and/or may reflect user preferences. At block 610, a PWM signal based on the adjusted duty cycle is provided to illuminate the display.

The above discussion is meant to be illustrative of the principles and various embodiments of the present invention. Numerous variations and modifications will become apparent to those skilled in the art once the above disclosure is fully appreciated. For example, FIGS. 4-6 represent exemplary embodiments only. Thus, one or more of the functional blocks shown in FIG. 4 may be combined, performed simultaneously, performed in a different order and/or omitted. Likewise, one or more of the functional blocks of FIG. 5 or FIG. 6 may be combined, performed simultaneously, performed in a different order and/or omitted. It is intended that the following claims be interpreted to embrace all such variations and modifications.

What is claimed is:

1. A system, comprising:

a processor;

a controller coupled to the processor; and an electronic display coupled to the controller, wherein the controller is configured to interpret a plurality of control signals, each control signal capable of dynamically controlling electronic display brightness without user input, and to generate an output signal to control electronic display brightness based on the interpreted control signals, wherein the control signals comprise a graphics content indicator and at least one of a power supply indicator and an ambient light indicator.

2. The system of claim 1 wherein the controller couples to a graphics controller and wherein at least one of the control signals is associated with the graphics controller.

3. The system of claim 2 wherein the at least one control signal associated with the graphics controller is generated based on graphics shown or graphics to be shown on the electronic display.

4. The system of claim 1 wherein at least one of the control signals comprises a pulse width modulation (PWM) signal and wherein the controller comprises a PWM interpreter that receives the PWM signal and determines a duty cycle of the PWM signal.

5. The system of claim 4 wherein the PWM interpreter comprises a modulation cycle-width estimator that receives the PWM signal and estimates a modulation cycle-duration by counting a number of clock cycles between subsequent rising edges of the PWM signal.

6. The system of claim 4 wherein the PWM interpreter comprises a pulse-width estimator that receives the PWM signal and estimates a pulse-duration by counting a number of clock cycles between a rising edge and a subsequent falling edge of the PWM signal.

7. The system of claim 4 wherein the PWM interpreter comprises a duty-cycle estimator coupled to a modulation cycle-width estimator and a pulse-width estimator, the duty-cycle estimator determines the duty-cycle by comparing the number of clock cycles counted by the modulation cycle-width estimator with the number of clock cycles counted by the pulse-width estimator.

8. The system of claim 4 wherein the PWM interpreter comprises a low-pulse estimator that receives the PWM signal and estimates a low-pulse duration by counting a number of clock cycles between a falling edge and a subsequent rising edge of the PWM signal.

9. The system of claim 4 wherein the PWM interpreter comprises:

a low pass filter that averages the PWM signal over a time period; and an analog-to-digital converter coupled to the low pass filter, the analog-to-digital converter receives the average of the PWM signal over the time period and outputs a digital value of the average.

10. The system of claim 9 wherein the time period is approximately equal to a modulation duty cycle of the PWM signal.

11. The system of claim 1 wherein the control signals are associated with components selected from the group consisting of:

a power supply coupled to the controller;

an ambient light sensor coupled to the controller; and a graphics controller coupled to the controller.

12. The system of claim 1 wherein the controller is configured to determine a validity of the control signals and to automatically adjust the output signal based on the determined validity of the control signals.

13. The system of claim 1 wherein the controller associates a control parameter with each control signal and generates the output signal based on a function associated with the control parameters.

14. The system of claim 13 wherein the function weights the control parameters to optimize power consumption by the electronic display.

15. A controller, comprising:

an interpreter unit configured to receive a provisional control signal for controlling a backlight and to determine an attribute of the control signal;

a control unit configured to receive an input signal from the interpreter unit based on the attribute and to receive additional input signals from at least one other component of a system that employs the controller, the control unit performs an analysis of the input signals to identify opportunities to decrease power consumption by the backlight without user intervention; and a generator unit coupled to the control unit and configured to generate a final control signal to control the backlight based on the analysis.

16. The controller of claim 15 wherein the provisional control signal received by the interpreter comprises a pulse width modulated (PWM) signal and the attribute comprises a duty cycle of the PWM signal.

17. The controller of claim 15 wherein the provisional control signal received by the interpreter is generated based on an analysis of graphics data shown or graphics data to be shown on an electronic display.

18. The controller of claim 15 wherein the control unit analyses the input signals to identify invalid signals and wherein, if any of the input signals are identified as invalid, causes the generator unit to generate the final control signal without dependence on the invalid signals.

19. The controller of claim 15 wherein the input signals are associated with at least one of the group of graphics content information, power supply information, and amount of ambient light surrounding a display associated with the backlight.

20. The embedded controller of claim 15 wherein the final control signal is generated to adjust a brightness of the backlight over a predetermined time period.

21. A method, comprising:

controlling electronic display brightness based on a plurality of parameters;

determining if signals corresponding to the parameters are valid;

nullifying parameters associated with signals that are determined to be invalid; and controlling the electronic display brightness based on the parameters that have not been nullified.

22. The method of claim 21 wherein determining if signals corresponding to the parameters are valid comprises determining if signals corresponding to at least one graphic content parameter, at least one ambient light parameter, at least one power supply parameter and at least one user input parameter are valid.

23. The method of claim 21 wherein nullifying parameters comprises adjusting a function that implements the parameters so that the effect of parameters associated with signals that are determined to be invalid is reduced.

24. The method of claim 21 further comprising controlling electronic display brightness by interpreting a duty cycle of a pulse width modulated (PWM) signal.

25. The method of claim 24 wherein controlling electronic display brightness comprises adjusting the duty cycle of the PWM signal when the PWM signal is determined to be valid.

26. A computer system, comprising:

means for processing;

means for illuminating a display;

means for determining an availability of a plurality of illumination control signals; and means for interpreting the illumination control signals and for selectively combining an intended effect of the illumination control signals based on availability.

27. The computer system of claim 26 further comprising means for determining if an illumination control signal based on graphics shown or graphics to be shown is available.

28. The computer system of claim 26 further comprising means for determining if an illumination control signal based on power provided to the computer system is available.

29. The computer system of claim 26 further comprising means for determining if an illumination control signal based on amount of ambient light surrounding the electronic display is available.

30. The system of claim 26 further comprising means for determining a validity of the illumination control signals.

31. The system of claim 30 further comprising means for selectively combining an intended effect of illumination control signals based on validity.

* * * * *

UNITED STATES PATENT AND TRADEMARK OFFICE

CERTIFICATE OF CORRECTION

PATENT NO. : 7,456,829 B1
APPLICATION NO. : 11/003774
DATED : November 25, 2008
INVENTOR(S) : Walter G. Fry It is certified that error appears in the above-identified patent and that said Letters Patent is hereby corrected as shown below:

In column 6, line 12, delete "CP," and insert -- $CP_1$ --, therefor.

Signed and Sealed this

Seventh Day of April, 2009

JOHN DOLL
*Acting Director of the United States Patent and Trademark Office*